United States Patent [19]

Joy

[11] 4,239,134

[45] Dec. 16, 1980

[54] FLEXIBLE THIMBLE

[76] Inventor: Carole Joy, 144 Arcadia Ave., Santa Clara, Calif. 95051

[21] Appl. No.: 695,209

[22] Filed: Jun. 11, 1976

Related U.S. Application Data

[63] Continuation of Ser. No. 570,261, Apr. 21, 1975, abandoned.

[51] Int. Cl.[2] ..... D05B 91/04

[52] U.S. Cl. ..... 223/101

[58] Field of Search ..... 223/101; 2/21

[56] References Cited

U.S. PATENT DOCUMENTS 2,207,672 7/1940 Levey ..... 223/101

2,447,774 8/1948 Salisbury ..... 223/101

FOREIGN PATENT DOCUMENTS 669270 4/1952 United Kingdom ..... 223/101

*Primary Examiner*—George H. Krizmanich

*Attorney, Agent, or Firm*—Richard Alan Brown

[57] ABSTRACT

A new and improved thimble for sewing, particularly a thimble of flexible material; which allows the thimble to conform to the finger for fit and comfort; provides a supple surface to allow the user to actually feel the needle; and provides a protective means located near the closed end of the thimble for covering part of the normal fingertip and fingerprint area, to protect the finger from the penetration of sharp objects.

1 Claim, 5 Drawing Figures

FLEXIBLE THIMBLE

This is a continuation of application Ser. No. 570,261 filed Apr. 21, 1975 now abandoned.

BACKGROUND OF THE INVENTION

1. Field of the Invention

The invention generally relates to thimbles primarily adapted for use in sewing and in particular to a sewing thimble that is flexible to conform to the finger and prevent injury to the finger from the needle.

2. Description of the Prior Art

Conventional thimbles are well-known and have been constructed in various forms. In the past thimbles have been constructed of relatively hard material that does not completely conform to the finger. The disadvantage of this type of thimble is that it is injurious to the finger or, fingernail, causes pain and causes discomfort to the user. Also, most surfaces proposed, because of the hard material; do not allow the user to feel the needle, with the finger the thimble covers, while pulling the needle through material.

Other thimbles have been proposed that have slots or openings with rigid projections for the provision of the extension of the fingernail of the user. An example of such a structure is disclosed in U.S. Pat. No. 2,447,774 by L. B. Salisbury for Thimbles. This thimble suffers from the disadvantage of other rigid thimbles and the disadvantage that the projection for the fingernail presents harsh edges which can, while the thimble is being used, break the fingernail.

Another type thimble has been proposed such as U.S. Pat. No. 2,207,762 by A. M. Levey for Rubber Thimble which disclosed a rubber thimble which apparently fits snuggly upon the finger of the user. This proposed thimble has a hard material embedded throughout, except for the top of the finger behind the fingernail which thimble area is constructed of rubber to allow for various sized fingers. This thimble has the disadvantage that the user cannot feel the needle against the finger while pulling the needle through material and suffers from the problems noted for other conventional rigid thimbles.

Yet another type thimble has been disclosed in U.S. Pat. No. 2,528,967 by E. L. Schiavone for Sewing Thimble, this thimble disclosed the conventional rigid thimble but has a friction material covering part of the outer surface of the thimble to assist the seamstress in pulling the needle through thick or resistive material. It is noted this thimble suffers from the disadvantages previously noted for the other conventional hard or rigid material thimbles.

SUMMARY OF THE INVENTION

The flexible thimble of the present invention overcomes and mitigates the disadvantages of the above-described prior art in that the present invention discloses a thimble wherein the flexible material allows the thimble to conform to the finger for utmost fit and comfort without causing pain, soreness, inflamation or discomfort, yet the protective means disposed inside the shell and positioned beneath the crescent opening near the tip of the finger and also covering part of the fingerprint area prevents penetration of either the point or the eye of the needle or other sharp object through the shell. Also, the supple surface allows the seamstress to feel the (pressure of the) needle while pulling the needle through resistant material. Further, the crescent opening allows the fingernail to protrude through the closed end with no harsh surfaces to damage the fingernail.

In accordance with the present invention a flexible thimble is provided which comprises: a tapered tubular shell formed from a flexible material and having a closed end thereof, the closed end of the shell having an opening over an annular section of the closed end for providing access for a fingernail and protective means disposed in the closed end of the shell for preventing penetration of sharp objects, whereby said protective means covers the ball portion of a fingertip communicating with the shell.

Thus, an advantage of the present invention is to provide a flexible thimble that conforms to the finger of the user for utmost fit and comfort which is of importance to the average person and an even greater advantage to a person that has a deformed finger, such as one with a bumped, calloused or arthritic condition. Yet, this thimble has a means to protect the finger when pushing the needle through a resistant material.

Another advantage of the present invention is to provide the seamstress with an external thimble surface that will assist the seamstress when pulling the needle through material rather than hinder such efforts as is the case with the slippery surfaced conventional thimble.

Yet another advantage of the present invention is to provide a shell that is flexible and allows the user while sewing better control of the needle.

Still further, an advantage of the present invention is to permit the fingernail to protrude through the crescent opening or slot, in the closed end, with no harsh or sharp edges to damage or break the fingernail.

BRIEF DESCRIPTION OF THE DRAWINGS

In the drawings, forming a part of the specification and wherein like reference numerals are employed to designate like parts throughout the same, in which.

DETAILED DESCRIPTION

Figure 2:
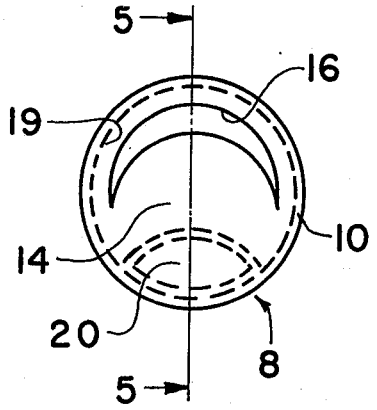
FIG. 2 is an enlarged closed end elevation view of the thimble of this invention.
Figure 1:
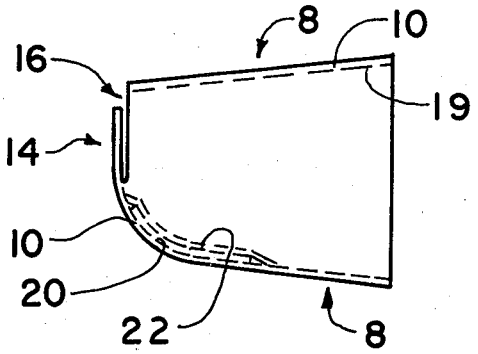
FIG. 1 is an enlarged side elevation view of the thimble of this invention.
Figure 3:
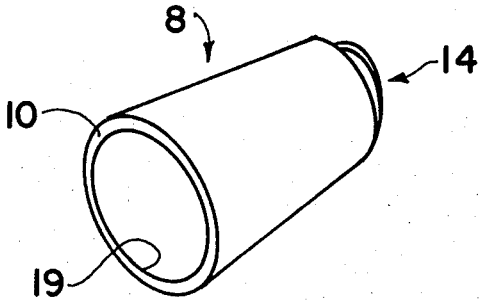
FIG. 3 is an enlarged perspective view of the thimble of this invention.

Referring now to FIGS. 1, 2 and 3, a flexible thimble 8 of the present invention is shown in several views. The thimble 8 comprises a tapered shell 10 formed from a flexible material such as, but not limited to, rubber, plastic or leather. The thimble 8 is tubular, which enables receiving the end of a finger 12.

The shell 10 has a closed end 14 having a crescent opening 16 therein to allow protrusion of a fingernail 18 through the crescent opening. As may be seen in FIG. 2, the crescent opening is substantially concentric with and along the center line 5—5 of the Shell 10. However, it is recognized other configurations for the opening may be satisfactory.

In using a thimble of this type, the external surface (i.e., fingertip and normal fingerprint area) of the finger 12 contacts and communicates with the inside surface 19 of the closed end 14 of the shell 10. A substantially impenetrable member 20, such as, but not limited to, plastic or metal, is located between the inside surface of the shell 10 and a second flexible material 22, as may be seen in FIG. 5. The member 20 is normally disposed for contacting the finger 12 at the ball point of the fingertip and the closed end 14 of the inside surface 19 and continuing to a portion of the normal fingerprint area. It is recognized, however, that the member 20 can be embedded within the shell, or that the member 20 can communicate with the shell 10 through other methods of attachment, with the member 20 located at the above-described position. The member 20 is secured to the inside surface of the shell 10 by the second flexible material 22 and the member 20 is disposed therein for preventing penetration of a needle or the like through the thimble. Accordingly, the member 20 prevents possible injury to a seamstress, using the thimble, from the needle eye, point, or the like. The second flexible material 22 may comprise, for example, a plastic, leather or cloth material or the like.

Figure 4:
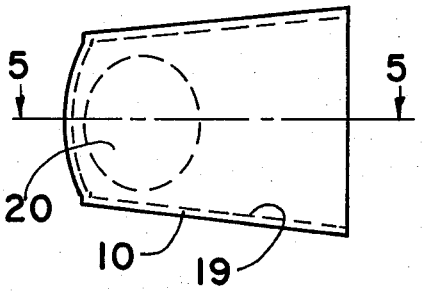
FIG. 4 is an enlarged top elevation view of the thimble of this invention.
Figure 5:
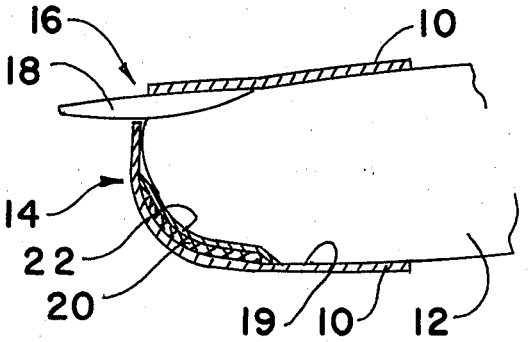
FIG. 5 is an enlarged cross-section view on the line 5—5 of FIGS. 2 and 4.

Referring now to FIGS. 1, 4 and 5, the member 20 is located near the closed end 14 of the shell 10 and adjacent to the inside surface 19 thereof. The member 20 is sufficiently large to cover that portion of the fingertip (e.g., the ball portion of the fingertip) susceptible to injury from a needle or the like.

Referring now to FIG. 4, a top view of the flexible thimble 8 is shown. The member 20 is illustrated by dashed lines as being eliptical in shape. Also, the member 20 may be concave to conform with the ball shape of a typical fingertip. It is to be noted, however, other shapes of the member 20 may be satisfactory.

What is claimed is:

1. A thimble for use in sewing with a needle comprising:

(a) a tapered tubular shell formed from a flexible material, said shell conforming to the shape of a finger inside said shell and sensation to touch being maintained with the finger from needle pressure communicating with said shell, and said shell having a closed end thereof, said closed end having an opening therein over an annular section of the closed end for providing access for a fingernail;

(b) a protective means disposed in said closed end of said shell for preventing penetration of sharp objects, said protective means being substantially impenetrable to sharp objects and being substantially oval in shape such that said protective means covers only the ball portion of the finger tip inside said shell; and, (c) means for securing said protective means against an inside surface of said shell wherein said means for securing said protective means comprises a flexible fabric material.

* * * * *